US006053717A

United States Patent [19]

Dixon

[11] Patent Number: 6,053,717

[45] Date of Patent: Apr. 25, 2000

[54] ROTARY PUMP WITH WIPER INSERT

[75] Inventor: Randy J. Dixon, 2135 Monad Rd., Billings, Mont. 59102

[73] Assignee: Randy J. Dixon, Billings, Mont.

[21] Appl. No.: 08/977,034

[22] Filed: Nov. 25, 1997

Related U.S. Application Data

[60] Provisional application No. 60/032,046, Nov. 26, 1996.

[51] Int. Cl.[7] ..... F01C 19/02

[52] U.S. Cl. ..... 418/122; 418/1; 418/113; 418/206.6

[58] Field of Search ..... 418/206.6, 122, 418/113, 1

[56] References Cited

U.S. PATENT DOCUMENTS 1,348,772 8/1920 Auger ..... 418/206.1
1,407,496 2/1922 Storey ..... 418/122
1,665,120 4/1928 Wendell ..... 418/122
5,567,140 10/1996 Dodd ..... 418/178

*Primary Examiner*—Thomas Denion
*Assistant Examiner*—Theresa Trieu
*Attorney, Agent, or Firm*—Sheridan Ross P.C.

[57] ABSTRACT

A positive displacement rotary pump with an improved impeller design integrating a replaceable wiper insert. The impeller generally has or more lobes and an equal number of conjugate surfaces. Each lobe has a cavity which holds a wiper blade. The wiper blade improves efficiency by making a seal with a pump chamber or the conjugate surface on the other impeller as it rotates. The wiper is pressed radially outward from a central axis of the impeller by a biasing means such as a spring.

19 Claims, 3 Drawing Sheets

ROTARY PUMP WITH WIPER INSERT

RELATED APPLICATION

This application claims the benefit of U.S. Provisional patent application Ser. No. 60/032,046, filed on Nov. 26, 1996.

FIELD OF THE INVENTION

The present invention relates to an improved semipositive displacement rotary pump. More particularly, the pump has an improved impeller with a replaceable wiper insert in the impeller lobe to improve the efficiency and performance of the pump.

BACKGROUND OF THE INVENTION

The prior art includes many rotary pumps for pumping liquids such as water, oil, gasoline, and other materials. In such pumps, the tolerance of clearance between the impellers and the pump chamber is critical to the proper functioning of the pump. The clearance must be great enough so the impellers do not touch a pump chamber wall and destroy various components of the pump, yet small enough that the pump operates efficiently and with minimal vibration by pushing the liquid through the pump chamber. Moreover, such pumps must be made out of materials that can maintain the required critical tolerance and withstand extreme vibration. As such, rotary pumps are expensive to manufacture and may suffer from a lack of a high degree of tolerance. Furthermore, many rotary pumps are difficult and expensive to maintain since after excessive wear, the entire impeller needs to be replaced.

U.S. Pat. No. 1,348,772 to Auger teaches the use of packing material, such as felt, on a end of each lobe of a rotary pump to help increase the efficiency of the pump. However, packing materials wear out quickly which reduces efficiency of the pump unless the packing material is replaced frequently. Additionally, materials such as felt are semi-porous which allows flow though the material and reduces efficiency. Furthermore, the packing material may come loose from the lobe at high speeds as the pump impellers rotate, which greatly reduces the efficiency of the pump, rendering it unusable.

An impeller lobe is most efficient when in extremely close proximity with either a housing or another impeller. Without a small tolerance between the impeller lobe and either the housing or other impeller, excessive backflow occurs resulting in lower efficiency. Additionally, the interaction between the area where the surface of one lobe tip comes in close proximity with the other impeller can cause hydraulic hammering which causes vibration and unnecessary wear of the shaft bearings. A general need is recognized to reduce the space between the lobe tip and either the housing or other impeller while limiting vibration and damage to the pump.

Therefore, there is a need for a rotary pump having a high degree of tolerance which is inexpensive to manufacture, maintains contact with either the interior chamber wall or other impeller, has an increased-wear replaceable wiper blade which does not come loose at high speeds, and which can be changed quickly and efficiently without significant expense.

SUMMARY OF THE INVENTION

Therefore, it is an object of the present invention to improve the efficiency of a rotary pump and to reduce the manufacturing costs of making such a pump. It is a further object of the present invention to provide an improved impeller which has a removable, extended-wear wiper blade which can be replaced quickly and cost effectively. Another object is to assure contact between the wiper blade and either the housing or other impeller by a spring or other biasing means and by the shape of the interior chamber wall and other impeller. Another object is that each wiper blade have a retention means which keeps the wiper blade attached to the impeller lobe during high rotational speeds of the impellers.

In one embodiment of the present invention, a semipositive displacement rotary pump is provided with an improved impeller which has a removable wiper blade insert with a surface in substantially constant contact with the chamber wall of the pump. Such a wiper blade improves the efficiency of the pump while decreasing the manufacturing cost of the pump as a result of reduced tolerances between the pump chamber wall and the end of the wiper blade. The spring or biasing means provides a force against the wiper insert within an impeller of the present invention, maintaining the wiper insert in substantially constant contact with the interior chamber wall of a pump or other impeller, even after significant wear of the wiper insert.

DETAILED DESCRIPTION OF THE INVENTION

Figure 1:
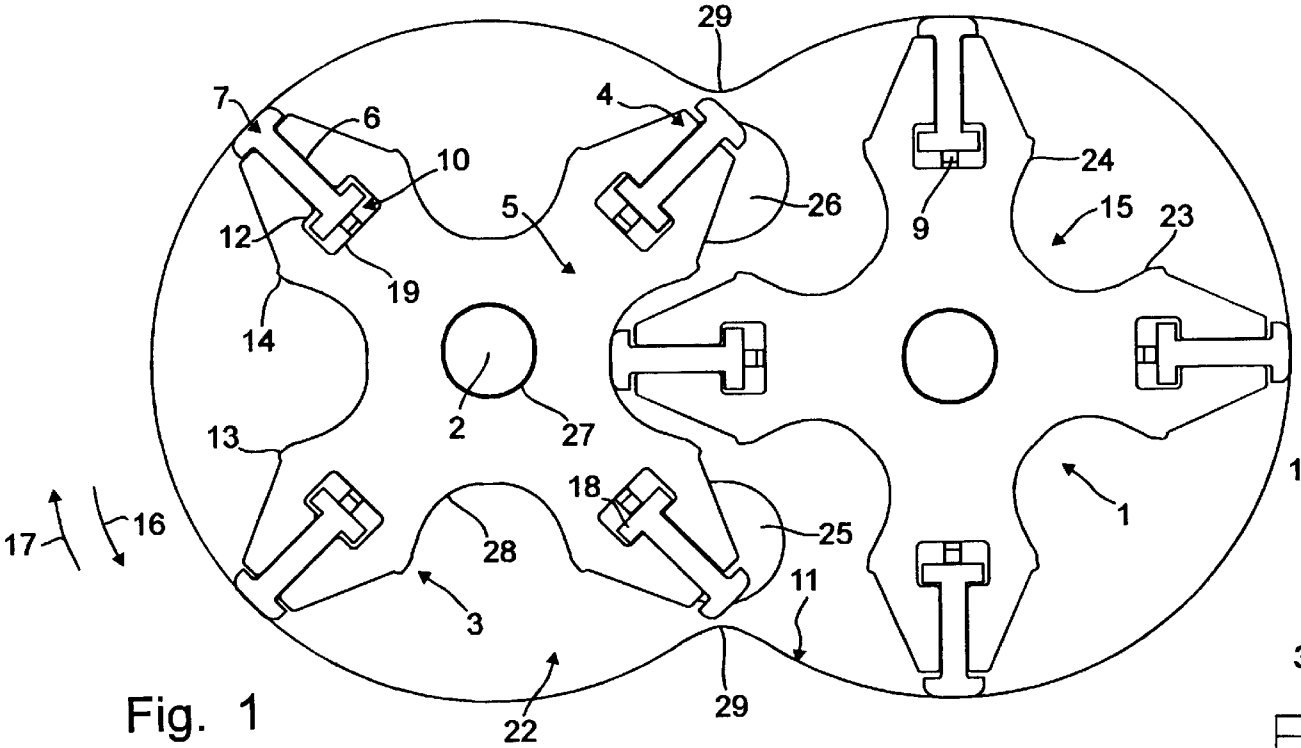
FIG. 1 is a top view of rotary impellers within an housing.

The present invention generally relates to an improved semi-positive displacement rotary pump. More particularly, the present invention provides an improved impeller 1 for use in a rotary pump. The impeller 1 has a removable wiper insert 8 which is secured at a tip 4 of one or more impeller lobes 3. In one embodiment, the wiper insert is operatively positioned near or within a cavity 10 of the impeller lobe 3 such that the wiper insert 8 is in direct contact with an interior chamber wall 11 of a pump chamber 22 or a substantially arcuate cut-out portion of the other impeller 15. Thus, the efficiency of the pump is improved compared to conventional rotary pumps which require a gap between the end of the impeller lobe tips 4 and the chamber wall 11 or other impeller to prevent excessive vibration.

One advantage of the improved impeller 1 for a rotary pump of the present invention is that the close tolerances of the clearance of the impellers 1 and the pump chamber 11 are not critical due to the impeller 1 and a wiper blade 7 design. In contrast, manufacturing tolerances which allow for the clearance of impellers 1 and pump chamber walls 11 as shown in the prior art are very critical. In these pumps, if the components are not within tolerance, the pump will not work due to loss of suction capacity and/or excessive vibration. In the pump of the present invention, the tolerances are not as critical, because the wiper insert is biased 9 to extend outward from the lobe tip 4 until prevented by the retention means 18 which interferes with a wiper insert stop 12. This ability to extend to varying degree as demonstrated in FIG. 1 allows the wiper blade 7 to remain in substantial constant contact with the pump chamber wall 11 or other impeller which assures peak efficiency.

FIG. 1 demonstrates the ability for the wipers to mask large manufacturing tolerances. If the impellers 1 were perfectly centered within the interior chamber wall 11, the extension would be the same for each wiper insert 8 as it passes the chamber wall 11. As shown in the FIG. 1, the wiper inserts 8 remain in contact with the chamber wall 11 even though the distance between the lobe tip 4 and the chamber wall 11 changes. Also shown in FIG. 1 is a wiper relief 29 in the interior chamber wall 11. The wiper relief 29 allows the wiper blade 7 to begin contact with the interior chamber wall 11 without binding.

Therefore, the pump of the present invention is less expensive to produce and can be made from a wider variety of materials than pumps previously utilized for similar uses. Prior to the present invention, similar pumps had to be made out of certain metals such as cast iron, aluminum, bronze, brass, and ferrous type metals, because the tolerances and the need to minimize vibration of the pump were critical. However, the wiper insert 8 improvement of the present invention allows the pump to be constructed with lower tolerances (i.e., greater distance between the pump chamber wall 11 and the impeller tips 4). Thus, the pump can be made out of numerous types of materials, including, but not limited to, cast iron, bronze, stainless steel, fiberglass, plastic, aluminum, engineered polymers, thermoplastics, rubber composites, foam rubber and ferrous type metals.

Yet another advantage of the improved rotary pump of the present invention is that the suction capability of the pump may be significantly and reliably increased over the suction capability of other rotary pumps since the wiper insert 8 is more efficient, non-porous and wears evenly. A tighter seal is created during rotation because of constant contact of the wiper blade 7 with the chamber wall 11, which improves pump efficiency over the life of the wiper insert 8. A spring or biasing means 9 improves the wear life of the blade 7 because it will extend the wiper insert as the blade 7 wears. Additionally, there is little chance the wiper insert 8 will detach from the lobe tip 4 at high speeds because of the interaction between the retention means 18 and the wiper stop 12 within the cavity 10. Subsequently, the pump suction performance is increased along with output performance and reliability.

Another advantage of the improved rotary pump of the present invention is that the wiper insert 8 is very easy to replace, making it possible to maintain a tight seal for the life of the pump. The wiper insert 8 of the present invention can be manufactured from a variety of materials including, but not limited to, rubber, nitrile, viton, polymers, nylon based resins, foam rubber, teflon and any other material which is generally wear-resistant and conducive to frictionally engage the surface of the pump chamber wall. Such a material can be selected to be compatible with materials from which the pump chamber wall 11 and impeller 1 is constructed. Preferably, the wiper insert 8 is additionally compatible with the fluid serviced through the pump and thus custom designed for the particular pump application.

A rotary pump of the present invention can have one or more impellers 1. In a preferred embodiment, a pump of the present invention has two axially symmetrical impellers. Each impeller 1 can turn either a forward 16 or reverse 17 direction which will define the flow of fluid through the pump. Normally, the fluid flows from a fluid inlet 25 to the fluid outlet 26, but the flow direction may be changed by reversing the rotation direction of the impellers. In this embodiment, each shaft 2 is independently driven so the impellers 1 do not touch each other nor do the lobes 3 of the impellers 1 touch the pump chamber wall 11. The impellers 1 are designed to fit within the chamber of the pump 22. There must be clearance between the lobe tips 4 of the impeller 1 and the pump chamber wall 11 because, as described above, the tolerance of this clearance is not critical due to the novel wiper blade 7 improvement of the present invention. Enough clearance is provided between the lobe tip 4 and the chamber wall 11 for the wiper blade 7 at minimum extension.

The impeller 1 of the present invention can have one or more lobes 3. Preferably, an impeller of the present invention has four lobes 3. Each lobe 3 of the impeller 1 has a first end or tip 4, located proximal to the pump chamber wall 11, and a second end 5, located proximal to a central axis 2. The lobes 3 are commonly disposed approximately 90° apart in a preferred embodiment (see FIG. 1 and 6).

Each impeller 1 has a plurality of substantially arcuate cut-out portions 15 equal to the number of lobes. Each of the substantially arcuate cut-out portions 15 having a conjugate surface 28. The wiper blade 7 on the other impeller 1 forms a seal over the conjugate surface 15 starting at a first end 23 and ending at a second end 24. Attached to the first end 23 of the conjugate surface 15 is an entry relief 13, while an exit relief is attached to the second end. The entry relief 13 has a non-linear rounded surface which allows the biasing means 9 to adjust the axial position of the wiper blade 7 with respect to the conjugate surface 15 without the wiper blade 7 binding upon entry to the conjugate surface 15. The exit relief 14 takes the same shape as the entry relief 13 to accommodate running the pump in the reverse direction 17. The interaction between the wiper blade 7 and the conjugate surface 15 as the impellers 1 turn provide higher pump efficiency without any hydraulic hammering effect which causes unwanted vibration in the prior art.

According to one embodiment, each lobe tip 4 has an interconnection means 6 for holding the wiper insert 8 in an axial radius coincident with the lobe 3. The interconnection means 6 is formed to removably, yet securely, hold the wiper insert 8 of the present invention such that the wiper insert 8 extends beyond the impeller lobe tip 4 and is maintained in substantially constant contact with the pump chamber wall 11 or conjugate surface 28 during rotation of the impeller. As such, the interconnection means 6 can be any shape suitable for holding the wiper insert 8 of the present invention in such a manner. Preferably, the interconnection means 6 is a cavity 10. The cavity 10 may have narrow opening at a most distal edge of the lobe tip 4 such that the blade 7 of the wiper insert 8 is projected through the opening.

In one embodiment, an impeller of the present invention has a biasing means 9 which is situated between the wiper insert and the back edge 19 of the wiper insert cavity 10. The biasing means 9 provides substantially constant pressure on the wiper insert 8 such that the wiper insert 8 is pushed toward a pump chamber wall 11 or conjugate surface 28. That is, the biasing means when compressed will have a tendency to expand outwardly toward the chamber wall 11 or conjugate surface 28. This biasing provides for extended wiper blade 7 life and improved pump efficiency. In one embodiment the biasing means 9 is a mechanical type spring. Such a biasing element can be metal, plastic, rubber, or any non-wearing material. In another embodiment, the biasing means 9 may be accomplished by the material utilized for the wiper insert 8 as shown in FIGS. 2–5. The biasing means 9 can be rated at different tensions to accommodate wear factors of different materials. These materials include, but are not limited to rubber, nitrile, viton, teflon, polymers, nylon based resins, foam rubber, or any material with expansive properties.

Figure 2:
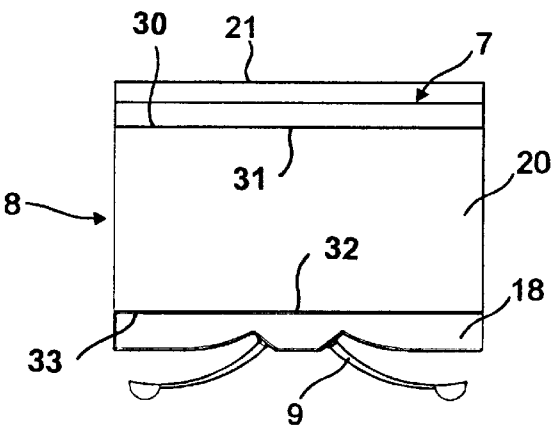
FIG. 2 is a side view of a preferred wiper blade embodiment.
Figure 3:
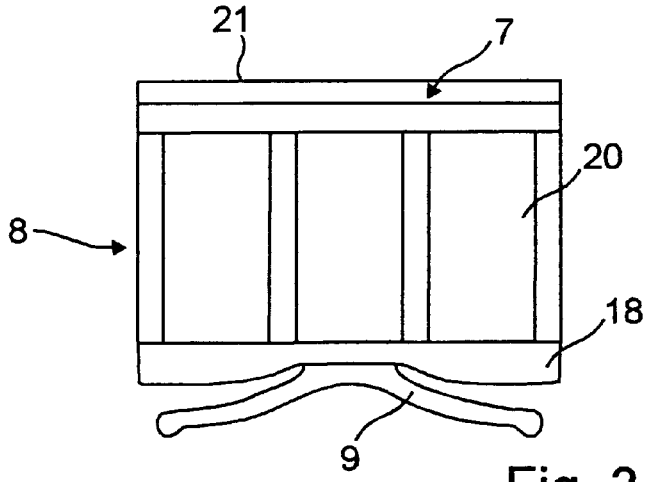
FIG. 3 is a side view of a second wiper blade embodiment.
Figure 4:
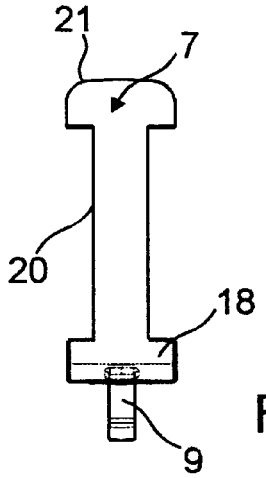
FIG. 4 is a front view of the preferred wiper blade; embodiment.
Figure 5:
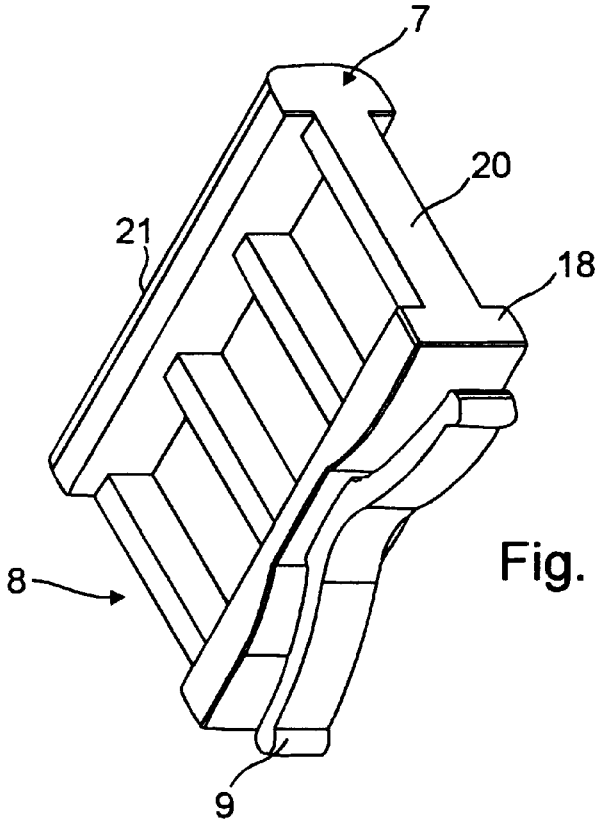
FIG. 5 is a perspective view of the second wiper blade embodiment.

The wiper insert 8 of the present invention is of a shape which will fit securely to the interconnection means 6 as described herein. Preferably, the wiper insert 8 comprises the blade 7, elongated portion 20, retention means 18, and biasing means 9. Referring to FIG. 2, the wiper blade 7 has an edge 21 and an inner end 30. The elongated portion 20 has an outward end 31 and an inward end 32, with the outward end 31 attached to the inner end 30 of the wiper blade. The retention means 18 has a primary end 33 and secondary end 34 where the primary end 33 is connected to the inward end 32 of the elongated portion 20. The wiper blade 7 can be of any form capable of maintaining substantially constant contact with the pump chamber wall 11 or conjugate surface 28 when attached to the impeller lobe tip 4. The blade portion 7 is joined to the elongated portion 20 of the wiper insert 8 such that the edge 21 of the blade 7 is in substantially constant contact with the pump chamber wall 11 or conjugate surface 28.

Figure 6:
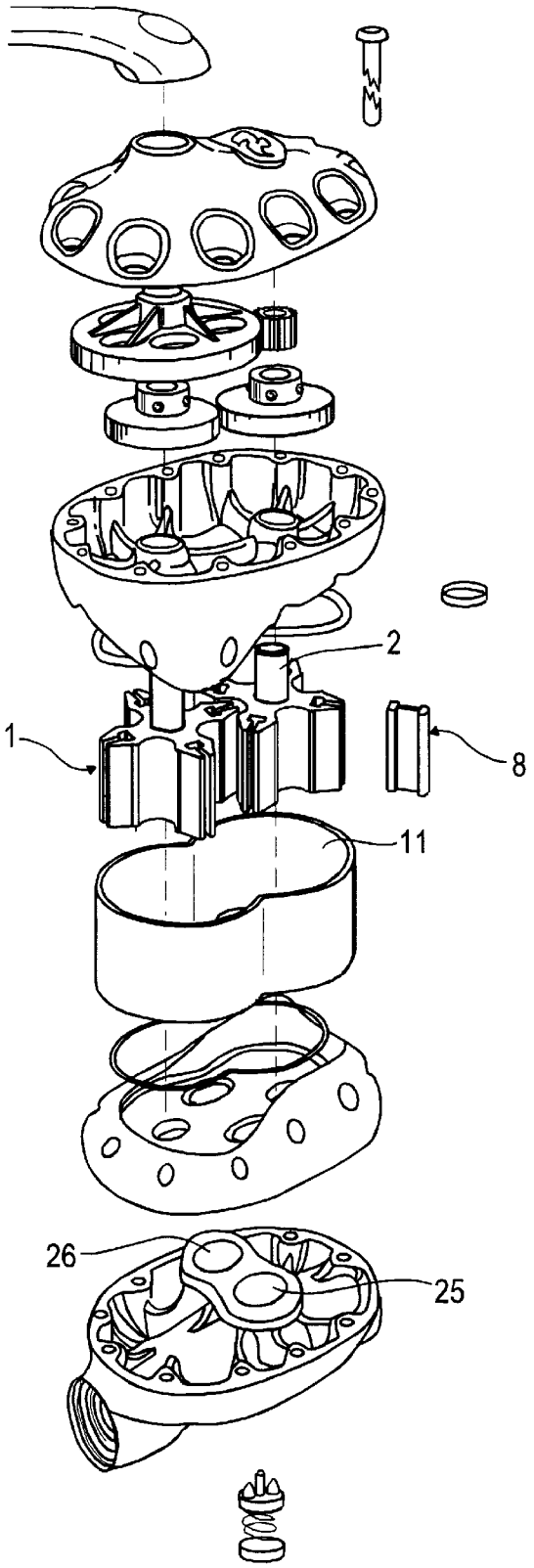
FIG. 6 is an expanded perspective view of an embodiment of the whole hand drive rotary pump.

The preferred embodiment rotary pump of the present invention depicted in FIG. 6 is a semi-positive displacement, gear driven, rotary pump which is timed and synchronized, with independently timed impellers 1. The pump comprises a cylindrical housing generally having arcuate interior chamber walls 11. The walls are separated by a fluid inlet space joined to a fluid inlet 25 and a fluid outlet space joined to a fluid outlet 26. The rotary pump of the present invention can be made with virtually any size inlet 25 and outlet 26 depending on the application. The pump of the present invention has a motorized or hand driven pump head coupled axially to the shafts to rotate the impellers 1 and impart mechanical energy to the fluid.

Bearings are used in a pump of the present invention to reduce friction. Such bearings are coupled, for example, to the axial shafts 2. Preferably, the pump of the present invention has needle bearings. Needle bearings used in a pump of the present invention provide significant advantages. For example, needle bearings are manufactured to hold closer tolerances, extend the life of the pump significantly, and allow less friction between pump components. Less energy is required to operate the pump due to better suction and discharge performance of the pump, thus requiring less maintenance than other types of bearings.

The pump also has a sleeve pressed onto the shaft 2 which provides strength to the shaft 2. More particularly, a sleeve is an inner race for the bearing, which is pressed onto the shaft 2. The sleeve generally increases the life of the bearing and the shaft 2 because the bearing and sleeve, or inner race, are constructed of the same metals and therefore have the same hardness. This design enables the use of unlimited types of material to make the pump shaft 2. The sleeve of the present invention is custom designed for a needle bearing because inner races are not normally used with needle bearings.

The pump has seals comprised of mechanical seals, spring seals, packed seals, porcelain seals, spring reenforced lip seals, or any seal that physically fits the housing and shaft of the pump of the present invention. Preferably, the pump has high-pressure lip seals.

For clarity purposes, the following is a list of components and associated numbering as identified in the drawings and provided herein:

1 Impeller
2 Axial Shaft or Drive Shaft
3 Impeller Lobe
4 First End or Tip of Lobe
5 Second End of Lobe
6 Interconnection Means
7 Wiper Blade
8 Wiper Insert
9 Biasing Means
10 Cavity
11 Interior Chamber Wall
12 Wiper Insert Stop
13 Wiper Entry Relief
14 Wiper Exit Relief
15 Substantially Arcuate Cut-out Portion
16 Forward Impeller Rotation Direction
17 Reverse Impeller Rotation Direction
18 Retention Means
19 Back Edge of Wiper Cavity
20 Elongated Portion of Wiper Insert
21 Blade Edge
22 Pump Chamber
23 First End of Conjugate Surface
24 Second End of Conjugate Surface
25 Fluid Inlet
26 Fluid Outlet
27 Impeller Hub
28 Wiper Blade Conjugate Surface
29 Chamber Wall Wiper Relief
30 Inner End of Blade
31 Outward End of Elongated Portion
32 Inward End of Elongated Portion
33 Primary End of Retention Means
34 Secondary End of Retention Means While various embodiments of the present invention have been described in detail, it is apparent that modifications and adaptations of those embodiments will occur to those skilled in the art. However, it is to be expressly understood that such modifications and adaptations are within the spirit and scope of the present invention.

What is claimed is:

1. A positive displacement rotary pump, comprising (a) a pump chamber, said pump chamber having an interior chamber wall;

(b) one or more impellers rotationally displaced within said pump chamber, each impeller comprising:

a hub located substantially in the center of each impeller, wherein each of said hubs rotates around a central axis of each of said impellers;

one or more lobes extending radially outward from each of said central axes, each of said lobes having a first end and a second end, said first end proximate to said chamber wall and said second end proximate to said central axis; and a substantially arcuate cut-out portion between each of said lobes on said impellers, each of said arcuate cut-out portions having a conjugate surface;

(c) a wiper insert, interconnected to said first end of each of said lobes, wherein each of said wiper inserts operatively engages said interior chamber wall when each of said first ends of each of said lobes is proximate to said interior chamber wall and each of said conjugate surfaces when each of said first ends of each of said lobes is proximate to each of said conjugate surfaces, said wiper insert further having a blade having an edge and an inner end and an elongated portion having an outward end and an inward end, wherein said outward end is interconnected to said inner end of said blade and a retention means having a primary end and a secondary end wherein said primary end is interconnected to said inward end of said elongated portion; and (d) a biasing means interconnected to said secondary end of said retention means for providing a force to each of said wiper inserts in a direction radially outward from each of said central axes; and (e) a drive means interconnected to each of said hubs, wherein said drive means rotates each of said hubs and said impellers to operatively move fluid through said pump chamber.

2. The positive displacement rotary pump of claim 1, wherein said conjugate surface further comprises:

a first end and a second end, wherein said wiper insert travels from said first end to said second end of said conjugate surface as said impeller rotates;

an entry relief having a non-linear rounded surface interconnected to said first end of said conjugate surface; and an exit relief having a non-linear rounded surface interconnected to said second end of said conjugate surface, wherein said entry and exit relief substantially inhibit said wiper inserts from becoming damaged upon entry into said arcuate cut-out portion.

3. The positive displacement rotary pump claim 1, wherein said drive means is comprised of a motor or a manually driven hand crank.

4. An impeller capable of being rotated within a chamber of a rotary pump, said chamber having an interior chamber wall, said impeller comprising:

at least one lobe extending radially outward from a hub interconnected to a drive shaft, each of said lobes having a first end and a second end, each of said first ends being proximate to said chamber wall and each of said second ends being proximate to said drive shaft;

each of said first ends of each of said lobes having an interconnection means to operatively hold a wiper insert, said wiper inserts having a blade extending radially outward for operative engagement of said interior chamber wall, said blade having an edge and an inner end and an elongated portion having an outward end and an inward end, wherein said outward end is interconnected to said inner end of said blade, and a retention means having a primary end and a secondary end, wherein said primary end is interconnected to said inward end of said elongated portion; and a biasing means operatively interconnected to said lobe and providing force to push each of said wiper inserts in a direction radially outward from said hub, wherein said blade of said wiper insert operatively engages said interior chamber wall as said lobes rotate within said rotary pump.

5. The impeller of claim 4, wherein each of said wiper inserts comprises rubber, nitrile, viton, teflon, polymers, nylon based resins, or foam rubber.

6. The impeller of claim 4, wherein said biasing means is in operative contact with each of said wiper inserts.

7. The impeller of claim 4, wherein said biasing means is a spring.

8. The impeller of claim 4, wherein said interconnection means is a cavity operably sized to receive a portion of said wiper insert and having a general configuration which substantially impedes said wiper insert from becoming disengaged from said impeller.

9. The impeller of claim 4, wherein said interconnection means comprises a wiper insert stop, said wiper insert stop preventing said wiper insert from dislodging when said impeller rotates at a high rate of speed.

10. The impeller of claim 4, further comprising a substantially arcuate cut-out portion between each of said lobes, each of said arcuate cut-out portions having a conjugate surface, wherein each of said wiper inserts on a first impeller operatively engages a respective conjugate surface on a second impeller when each of said first ends of said lobes of said first impeller is proximate to said respective conjugate surface of said second impeller.

11. The impeller of claim 10, wherein said conjugate surface further comprises:

a first end and a second end, wherein said blade of said wiper insert travels from said first end to said second end of said conjugate surface as said impeller rotates;

an entry relief having a non-linear rounded surface interconnected to said first end of said conjugate surface; and an exit relief having a non-linear rounded surface interconnected to said second end of said conjugate surface, wherein said entry and exit relief substantially inhibit said blades of said wiper inserts from becoming damaged upon entry into said arcuate cut-out portion.

12. The impeller of claim 4, wherein said wiper insert is removably interconnected.

13. The impeller of claim 4, wherein said biasing means is a biasing element comprised of metal, plastic, rubber, or polymers with expansion properties.

14. A positive displacement rotary pump, comprising:

an interior chamber wall;

a first and second impeller located within said interior chamber wall, each of said first and said second impellers having one or more lobes and an equal amount of substantially arcuate cut-out portions, alternatively surrounding a hub, said hub substantially in the center of each of said impellers, said arcuate cut-out portions having a conjugate surface;

a wiper insert interconnected to each of said lobes by a retention means, said wiper inserts comprising a blade having an edge and an inner end and an elongated portion having an outward end and an inward end, wherein said outward end is interconnected to said inner end of said blade, and a retention means having primary end and secondary ends wherein said primary end is interconnected to said inward end of said elongated portion; and a biasing means interconnected to said secondary end of said retention means which provides a force upon each of said wiper inserts in a direction which is outward from said hub; and a drive means operatively interconnected to said hub for rotating said first and said second impellers, wherein as said first and second impellers rotate said wiper inserts operatively engage said interior chamber wall to push a fluid through said rotary pump.

15. The positive displacement rotary pump of claim 14, wherein said wiper inserts interconnected to said lobes of said first impeller operatively engage said interior chamber wall or said conjugate surface of said second impeller, and said wiper inserts interconnected to said lobes of said second impeller operatively engage said interior chamber wall or said conjugate surface of said first impeller as said first and second impellers rotate.

16. The positive displacement rotary pump of claim 14, wherein said conjugate surface further comprises:

a first end and a second end, wherein said wiper insert travels from said first end to said second end of said conjugate surface as said impeller rotates;

an entry relief having a non-linear rounded surface interconnected to said first end of said conjugate surface; and an exit relief having a non-linear rounded surface interconnected to said second end of said conjugate surface, wherein said entry and exit relief substantially inhibit said wiper inserts from becoming damaged upon entry into said arcuate cut-out portion.

17. The positive displacement rotary pump of claim 14, wherein said wiper insert is removably interconnected.

18. A method for pumping fluid through a rotary pump, comprising the following steps:

introducing a fluid into a pump chamber from a fluid inlet;

rotating one or more impellers positioned within said pump chamber to impart mechanical energy to said fluid;

contacting an interior chamber wall of said pump chamber with at least one wiper blade interconnected to a distal end of said impellers, said wiper blade comprising an edge and and an inner end, an elongated portion having an outward end and an inward end, wherein said outward end is interconnected to said inner end of said blade and a retention means having a primary end and a secondary end, wherein said primary end is interconnected to said inward end of said elongated portion; and a biasing means interconnected to said secondary end of said retention means for biasing said wiper blades in a direction away from said hub to provide substantially constant contact between said wiper blade and said interior chamber wall;

wiping said interior chamber wall of said pump chamber as said wiper blade rotates about said hub, said wiping improving pumping efficiency of said rotary pump; and discharging said fluid from said pump chamber into a fluid outlet.

19. The method for pumping fluid of claim 18, wherein said wiper blade is biased with a spring.

* * * * *